US006869148B2

(12) United States Patent
Stein et al.

(10) Patent No.: US 6,869,148 B2
(45) Date of Patent: Mar. 22, 2005

(54) METHODS AND DEVICES FOR THE MANUFACTURE OF BRISTLE PRODUCTS

(75) Inventors: Bernd Stein, Schmitten (DE); Bryan Flood, Iowa City, IA (US)

(73) Assignee: Braun GmbH, Kronberg (DE)

( * ) Notice: Subject to any disclaimer, the term of this patent is extended or adjusted under 35 U.S.C. 154(b) by 209 days.

(21) Appl. No.: 10/236,121

(22) Filed: Sep. 6, 2002

(65) Prior Publication Data

US 2003/0042786 A1 Mar. 6, 2003

(30) Foreign Application Priority Data

Sep. 6, 2001 (DE) ..... 101 43 674

(51) Int. Cl.[7] ..... A46D 1/08
(52) U.S. Cl. ..... 300/7; 300/5
(58) Field of Search ..... 300/4, 5, 7

(56) References Cited

U.S. PATENT DOCUMENTS 3,367,719 A 2/1968 Carlson
4,360,236 A 11/1982 Boucherie
4,430,039 A 2/1984 Boucherie
5,033,797 A * 7/1991 Rueb ..... 300/5
5,518,301 A 5/1996 Boucherie

FOREIGN PATENT DOCUMENTS

DE 2643222 4/1978
DE 32 42 044 A1 5/1984
DE 34 24 681 A1 2/1986
DE 3806160 A1 9/1988
DE 295 14 993 U1 3/1997

OTHER PUBLICATIONS

Search Report from EP 02018309.

* cited by examiner

*Primary Examiner*—Randall Chin
(74) *Attorney, Agent, or Firm*—Fish & Richardson P.C.

(57) ABSTRACT

The invention is directed to a device for the manufacture of bristle products, in particular toothbrushes, with a feed unit for precut lengths of upstanding bristles arranged loosely in a supply duct, the bristles being routed directly to a picker segment picking up the bristles. The device includes a driven conveyor at the end of the supply duct close to the picker segment, or a further processing station.

28 Claims, 2 Drawing Sheets

METHODS AND DEVICES FOR THE MANUFACTURE OF BRISTLE PRODUCTS

CROSS-REFERENCE TO RELATED APPLICATION

This application claims the benefit of German application Ser. No. 101 43 674.2 filed Sep. 6, 2001.

TECHNICAL FIELD

This invention relates to methods and devices for the manufacture of bristle products, such as toothbrushes.

BACKGROUND

Devices for the manufacture of bristle products, such as toothbrushes, are well known.

Thus, for example, U.S. Pat. No. 4,360,236 describes a double fiber magazine for a brush manufacturing machine, comprising two magazines immovably connected to each other. The magazines are located opposite a picker or bundle plucker. According to this disclosure, each magazine is provided with a separating device and pressing components for pressing the fibers towards the bundle plucker. Moreover, provision is made for a device which alternately loads the fibers beyond the reach of the bundle plucker into one of the two fiber magazines. The double fiber magazine described in U.S. Pat. No. 4,360,236 finds application, for example, in the manufacture of toothbrushes comprising bristles of different color or different material.

U.S. Pat. No. 5,518,301 describes a method and a device for supplying fibers to a filling tool in a brush manufacturing machine. For each operating cycle, the method comprises the following steps: transporting a bundle of fibers from a selected fiber supply duct to a filling tool by means of a bundle take-up device which cooperates with at least two fiber supply ducts; using, for the selective supply of fibers, movable closing devices which cooperate with supply ends of the fiber supply ducts and ensure, by their movement, that fibers can only be taken from one fiber supply duct at a time by the bundle take-up device. The closing devices are mounted on a common support for simultaneous operation during each operating cycle.

DE 26 43 222 A1 also describes a method and a device for manufacturing brushes. In this specification, a brush manufacturing machine includes a bristle magazine which cooperates with one or several tufting devices. The brush manufacturing machine also includes a feed device for feeding bundled bristles to the magazine, and an opening device for opening the wraps holding the bristle bundles together. The feeding device is located in the transfer area on the magazine input side and includes a conveyor with holding devices for bristle bundles, which is constructed as a belt conveyor or as a chain in loop form.

DE 38 06 160 A1 discloses a pre-processing or work feeding machine for bristles in which the fibers are fed in the form of bundled or wrapped bristle clusters. In this method the wrap of the bristle clusters is opened automatically, and the fibers undergo a cleaning and orientation operation before being fed to the fiber supply ducts of a brush manufacturing machine. For transportation, the filaments are held clamped between flat belts, being thus moved forward in simple manner, in batches in conformity with the operating cycle.

It is a disadvantage of the known methods and constructions of the known filament supply ducts that zones occur in which a continuous filament flow is not allowed to develop. These zones, also referred to as dead zones, have an adverse effect on process safety and product quality.

Finally, U.S. Pat. No. 3,367,719 discloses a device for the manufacture of bristle products of the above-described type wherein a chain sprocket conveying device is provided at one side of the filament package.

SUMMARY

The invention features methods and devices for manufacturing bristle products economically with a high level of process safety and product quality.

In one aspect, the invention features a device for the manufacture of bristle products, in particular toothbrushes, including a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device that including opposite pressure surfaces, with the bristles being arranged therebetween.

Because clusters of bristles are conveyed actively by opposite pressure surfaces provided at both sides of the cluster of bristles, dead zones in which no continuous flow of bristles takes place are avoided. Effects known under the term "arching" or "bridging" generally will not occur because the bristles are fed actively from both sides. "Arching" or "bridging" is understood to mean an apparent interlocking of the bristle clusters, which impedes solid body flow. The pressure surfaces form a laterally bordering bristle track, between which the two sides of the bristle cluster abut by means of the bearing pressure formed by the pressure surfaces. In this way, a safe and steady conveyance of the bristles is achieved and, here, both pressure surfaces run synchronously at the same velocity.

Furthermore, active filament feed expedites the removal of interferences occurring in the filament bed, generally resulting in an increased product quality. This means that sections in the filament supply duct in which filaments have lost their upright orientation due to external influences are pushed out of the filament supply duct more quickly. This results in a reduced susceptibility to trouble and enhances process safety. In addition, it enables the filaments to be picked up symmetrically from the middle of the duct. To achieve this, it is preferred that the opposing conveying devices be arranged symmetrically at the duct. A higher constancy in the number of filaments flowing into the recesses of the picker segment on each operating cycle is also generally achieved.

Another advantageous effect is a reduced dependence upon the filament finish level. This means that the supply of bristle clusters is independent of the filament manufacturing process and the filament type while process safety is maintained at a consistently high level. This also enables processing of filaments proceeding at a very slow rate. This becomes apparent, for example, from the smooth processing of particularly fine filaments with a diameter less than, for instance, 0.12 mm, which corresponds to about 0.005 inch.

With the device of the present invention it is also possible to provide the requisite number of filaments per picker stroke. The use of a driven conveying device designated as active feed may be directly incorporated in the tuft forming process.

The terms "picker segment" or "picker tooling" refer to a tool for picking up the tufts and subsequently transferring them to their destination on the bristle carrier.

The pressure surfaces described above may include flat or toothed belts. The flat or toothed belts may be fabricated, for example, from a fabric-reinforced elastomer plastic. They may have a roughened or structured surface.

The longitudinal direction of the bristles may extend at a right angle to the direction of motion of the pressure surfaces. In this case, a cluster-like string of bristles may extend through the duct formed by the two opposed pressure surfaces. By this, individual tufts can be made in one draw in the picker segment.

Alternatively, individual bristles may run in the direction of motion of the conveying device. In this case, the duct or gap formed between the pressure surfaces is generally of the same size as the thickness of the bristles, so as to transport them separately in series or side-by-side.

The driven conveying device may include pressure elements for the application of transfer forces to the circumferential surface of outer lying bristles. For example, two opposed movable pressure elements may be provided, between which the stream of filament clusters is pushed through by appropriate forward or tangential forces.

The conveying device may include opposite gears or structural wheels having grooves adapted to receive the bristles therebetween. The conveying device may be equipped with two or several wheels made of metal or plastics.

The device may be configured to be synchronized with a subsequent sequence of operations. In this case, the filaments on both sides of the conveying device are generally transported steadily and synchronously, thus avoiding relative displacements of the individual bristles with respect to each other.

The device may be configured for the manufacture of filament strands. In this arrangement the exit opening of the conveying device may be of the adjustable type.

The device of the present invention is particularly suitable for processing of special filaments, since these are generally transported steadily in spite of different surfaces, cross-sections and work materials.

Further advantageous embodiments and aspects of the present invention will be described in the following with reference to the accompanying drawings.

DETAILED DESCRIPTION

Figure 1:
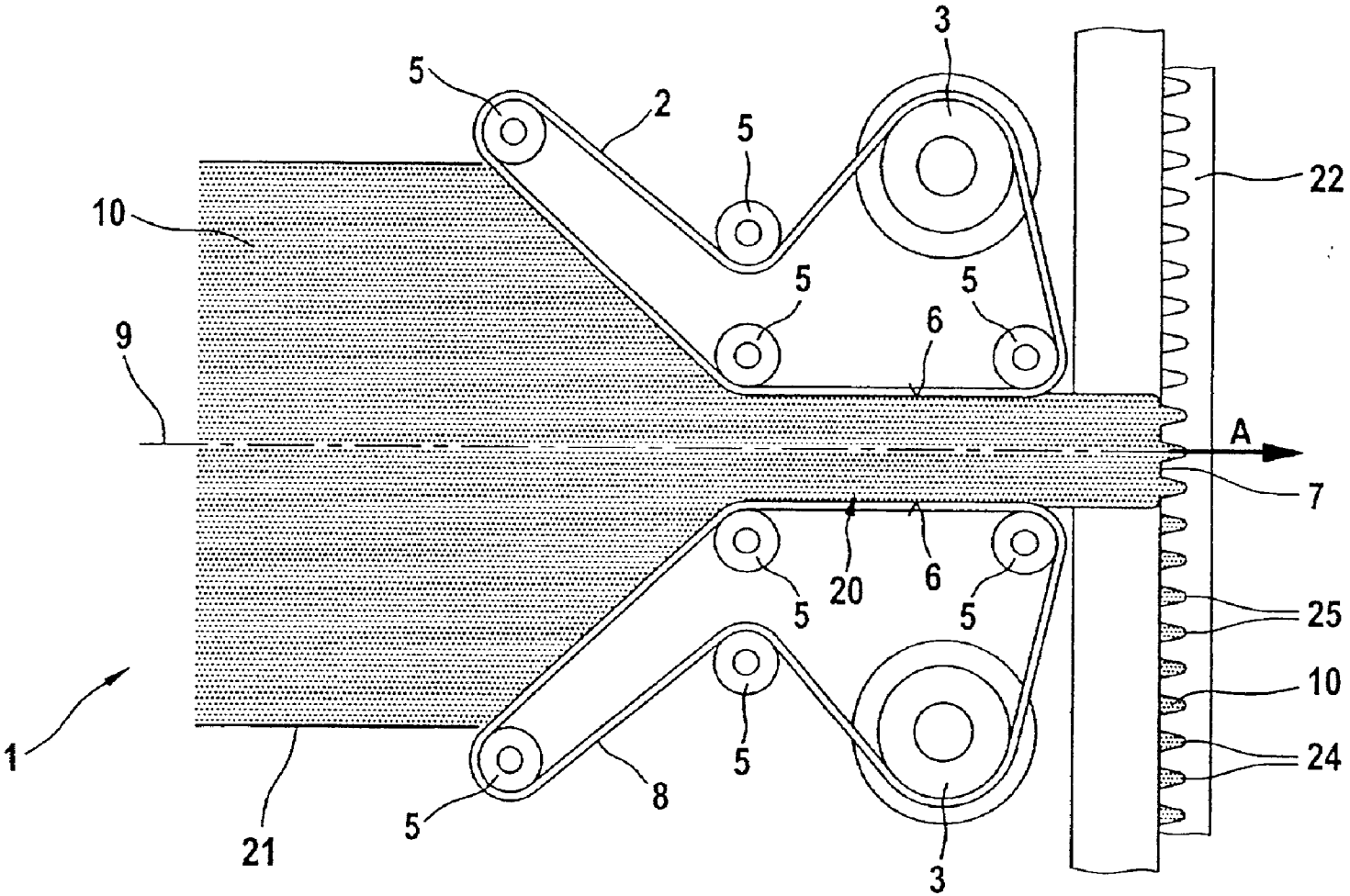
FIG. 1 is a schematic sectional view of an active feed unit illustrating a first embodiment of the present invention.

FIG. 1 shows in a schematic sectional view a first embodiment of an active feed unit 1, i.e., a driven bristle conveying device, including an upper conveyor belt 2 and a lower conveyor belt 8, each constructed as a driven flat belt of elastomer plastic.

The upper conveyor belt 2 and the lower conveyor belt 8 are arranged in mirror symmetry about an axis of symmetry 9. The architecture of the conveyor belts 2, 8 is therefore described only once.

The symmetrical conveyor belts 2, 8 each include one drive wheel 3 and four deflection pulleys 5. The conveyor belt 2, 8 is wrapped around the deflection pulleys 5 in such fashion that a straight-line tensioned pressure surface 6 parallel to the axis of symmetry 9 is produced between the two deflection pulleys 5. Arranged in spaced relation to the pressure surface 6 and the line of symmetry 9 is the drive wheel 3 around which the conveyor belt 2, 8 is wrapped for nearly half the wheel circumference. Adjacent to the drive wheel 3 is another deflection pulley 5 which bears against the conveyor belt 2, 8 from outside, hence acting as a pressure roller. Next to this pressure roller is another deflection pulley 5, which deflects the conveyor belt 2, 8 in the direction of the pressure surface 6.

The upper conveyor belt 2 and the lower conveyor belt 8 serve the function of transferring precut lengths of upstanding bristles 10, also referred to as filaments or strands, which are arranged loosely in a supply duct 21, without any damage occurring. As shown in FIG. 1, the pressure surface 6, 6 are both conveyed in a direction along the length of the surfaces 6, 6. The tangential forces applied by the pressure surfaces 6, 6 act to move the plural bristles 10 along the line of symmetry 9 in the direction of arrow A, producing a track 20 of bristles with the pressure surfaces 6 as its lateral boundaries. In FIG. 1, the bristles 10 extend at a right angle to the direction of arrow A, so that in FIG. 1 only the surfaces of the cut ends of the bristles 10 are visible which are depicted as points but which, in reality, lie closely to each other.

According to FIG. 1, at the end of the pressure surface 6 the bristles 10 approach an exit opening 7 of a predetermined diameter. Located at this opening is a picker segment 22, which is equipped with cavities 24 and combines the bristles 10 into tufts 25. For further processing, the bristles 10 are taken, for example, to mold bars (not shown) where their ends are sprayed with plastic so as to form a complete toothbrush head.

In another embodiment (not shown), only individual bristles 10 pass the bristle track 20, and thus the bristle track 20 is not wider than the diameter of the individual bristles 10 and the individual bristles 10 are transported in series through the very small bristle track 20. At the end of bristle track 20, the bristles 10 are conveyed in a recess for forming a tuft. When a recess is filled, it will be shifted sideways and the next recess comes up to the level of the very small bristle track 20 and can be filled with bristles 10.

Figure 2:
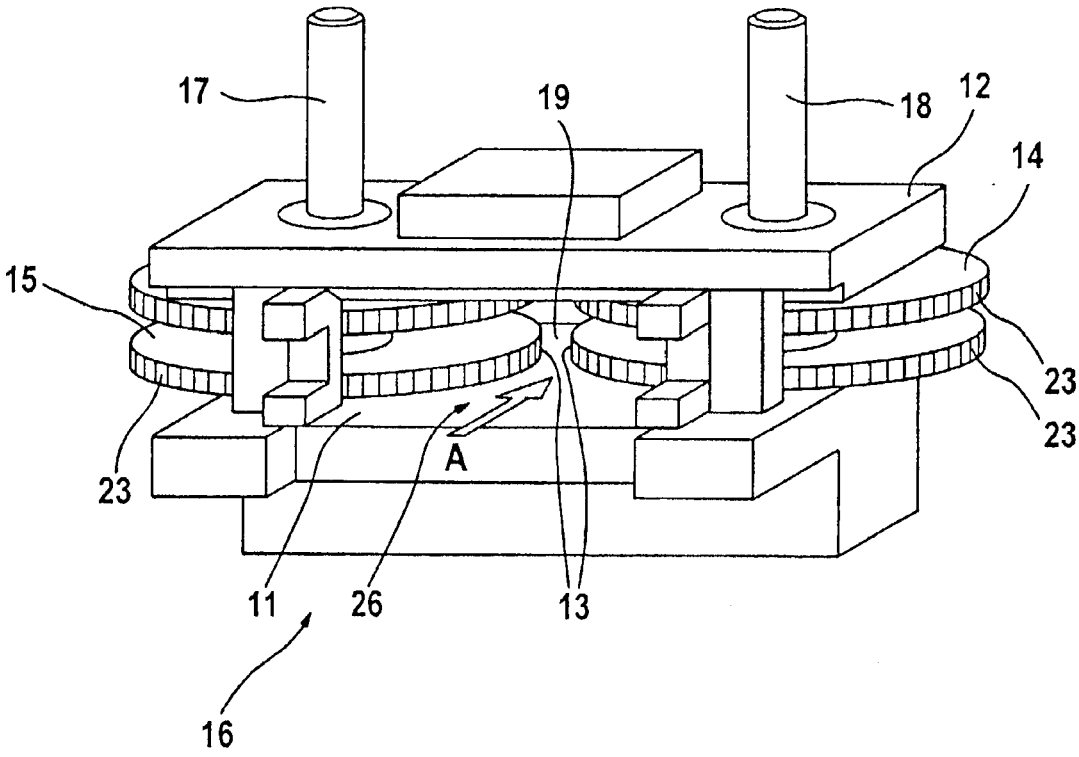
FIG. 2 is a perspective view of an active feed unit illustrating a second embodiment of the present invention.

FIG. 2 shows a perspective view of a second embodiment of an active feed unit 15. The feed unit 15 of this embodiment comprises a base plate 11 and a cover plate 12. The base plate 11 and the cover plate 12 are made from solid, machined metal. Rotatably arranged between the base plate 11 and the cover plate 12 are a right-hand gear 14 and a left-hand gear 15, each having grooves 23 into which the bristles 10 slide to be conveyed in the direction of arrow A. The two gears 14, 15 are driven by two synchronized drive shafts and are not in meshing engagement with each other, but rather, a gap 19 is provided between the right-hand gear 14 and the left-hand gear 15 through which precut lengths of upstanding bristles (not shown), also designated as filament clusters or strands, which are arranged loosely in a supply duct, are routed directly to a picker segment for picking up the tufts. The gears 14, 15 form the lateral boundaries for the gap 19 and serve as pressure surfaces 13, producing also in this area, similar to what has been described in the foregoing with reference to FIG. 1, a bristle track (not shown)which tapers in the direction of the gap 19.

Rotation of the gears 14, 15 produces on the pressure surfaces 13, 13 tangential forces which bear against the bristles, causing them to move in the direction of arrow A. Hence an active feed unit is obtained, preventing dead zones from developing in the bristle flow. In this embodiment the left-hand gear 15 rotates counterclockwise and the right-hand gear 14 clockwise, yet at equal speed and indexing time.

What is claimed is:

1. A device for the manufacture of bristle products, comprising a feed unit including a supply duct configured to receive a plurality of precut lengths of upstanding bristles; and a picker segment for picking up the bristles and combining them into tufts;

wherein the feed unit further includes a driven conveying device including opposite pressure surfaces, with the bristles arranged therebetween, both of the opposite pressure surfaces being conveyed in a direction along a length of the surfaces to deliver the bristles from the supply duct to the picker segment.

2. The device according to claim 1, wherein the pressure surfaces comprise flat belts.

3. The device according to claim 2, wherein the belts are made of a reinforced plastic.

4. The device according to claim 1, wherein the longitudinal direction of the individual bristles extend at a right angle to the direction of motion of the pressure surfaces.

5. The device according to claim 1, wherein the longitudinal direction of the individual bristles extend in parallel with the direction of motion of the pressure surfaces.

6. The device according to claim 1, wherein the driven conveying device includes pressure elements for the application of transfer forces to the circumferential surface of outer lying bristles.

7. The device according to claim 1, wherein the conveying device includes opposite gears having grooves adapted to receive the bristles therebetween.

8. The device according to claim 1 wherein the conveying device includes structural wheels having grooves adapted to receive the bristles therebetween.

9. The device according to claim 1 wherein the conveying device is adapted to be synchronized with a subsequent sequence of operations.

10. The device for the manufacture of bristle products according to claim 1 wherein the device is configured for the manufacture of filament strands and the driven conveying device includes an exit opening that is tapered in conformity with the desired thickness of the filament strand.

11. The device for the manufacture of bristle products according to claim 1 wherein the driven conveying device is configured for the processing of special filaments.

12. The device according to claim 1, wherein at least one of the pressure surfaces comprises a roughened surface.

13. The device according to claim 1, wherein the pressure surfaces comprise toothed belts.

14. The device according to claim 1, wherein the picker segment comprises a plurality of cavities to receive the bristles.

15. The device according to claim 1, wherein the opposite pressure surfaces are spaced apart by a distance less than or substantially equal to a diameter of one of the bristles.

16. The device according to claim 15, wherein the opposite pressure surfaces are spaced apart by a distance substantially equal to the diameter of one of the bristles.

17. The device according to claim 1, wherein at least some of the bristles have a diameter less than or equal to about 0.005 inch.

18. The device according to claim 1, wherein the opposite pressure surfaces are arranged symmetrically about an axis of symmetry.

19. The device according to claim 18, wherein the axis of symmetry comprises an axis along which the bristles are conveyed by the conveying device.

20. The device according to claim 1, wherein the conveying device comprises an adjustable exit opening.

21. A device for the manufacture of bristle products, comprising a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device including opposite flat belts, with the bristles being arranged therebetween.

22. A device for the manufacture of bristle products, comprising a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device including opposite pressure surfaces, with the bristles being arranged therebetween, wherein at least one of the pressure surfaces comprises a roughened surface.

23. A device for the manufacture of bristle products, comprising a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device including opposite toothed belts, with the bristles being arranged therebetween.

24. The device according to claim 23, wherein the belts are made of a reinforced plastic.

25. A device for the manufacture of bristle products, comprising a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device including opposite pressure surfaces, with the bristles being arranged therebetween, wherein the opposite pressure surfaces are spaced apart by a distance less than or substantially equal to a diameter of one of the bristles.

26. The device according to claim 25, wherein the opposite pressure surfaces are spaced apart by a distance substantially equal to the diameter of one of the bristles.

27. A device for the manufacture of bristle products, comprising a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device including opposite pressure surfaces, with the bristles being arranged therebetween, wherein the opposite pressure surfaces are arranged symmetrically about an axis of symmetry along which the bristles are conveyed by the conveying device.

28. A device for the manufacture of bristle products, comprising a feed unit including a supply duct configured to receive a plurality of precut lengths of upstanding bristles; and a picker segment for picking up the bristles and combining them into tufts;

the feed unit further including a driven conveying device configured to deliver the bristles from the supply duct to the picker segment, the driven conveying device including opposite pressure surfaces, with the bristles being arranged therebetween, wherein the conveying device comprises an adjustable exit opening.

* * * * *